US011027179B2

(12) United States Patent
Krause

(10) Patent No.: US 11,027,179 B2
(45) Date of Patent: Jun. 8, 2021

(54) PORTABLE TAILSPORTS GAME

(71) Applicant: Gary R. Krause, Livonia, MI (US)

(72) Inventor: Gary R. Krause, Livonia, MI (US)

( * ) Notice: Subject to any disclaimer, the term of this patent is extended or adjusted under 35 U.S.C. 154(b) by 108 days.

(21) Appl. No.: 15/884,586

(22) Filed: Jan. 31, 2018

(65) Prior Publication Data

US 2019/0232136 A1 Aug. 1, 2019

(51) Int. Cl.
*A63B 63/08* (2006.01)

(52) U.S. Cl.
CPC ..... *A63B 63/08* (2013.01)

(58) Field of Classification Search
CPC ..... A63F 7/0023; A63B 63/08; A63B 63/007
USPC ..... 273/398–402, 342, 409, 108, 407
See application file for complete search history.

(56) References Cited

U.S. PATENT DOCUMENTS 1,564,863 A * 12/1925 Laing ..... A63F 9/02 273/353
2,083,299 A * 6/1937 Hunter ..... A47G 29/093 108/26
3,232,619 A * 2/1966 Burk ..... A63B 63/08 273/123 R
3,372,934 A 3/1968 Heil
4,177,737 A 12/1979 Brickman
5,007,650 A 4/1991 Reed et al.
5,788,242 A * 8/1998 Rudell ..... A63B 69/0071 273/317.3
6,276,686 B1 8/2001 Chille
7,325,807 B1 2/2008 Eason
7,516,960 B1 4/2009 Battiste
7,805,959 B2 10/2010 Webb et al.
8,905,406 B2 12/2014 Brown
8,925,924 B1 * 1/2015 Urban ..... A63F 7/0616 273/108
D755,898 S 5/2016 Blanchard
2004/0188942 A1 9/2004 Trokan
(Continued)

FOREIGN PATENT DOCUMENTS

EP 1157720 A2 * 11/2001 ..... A63B 43/005
WO WO-2009047717 A2 * 4/2009 ..... A63B 67/002

OTHER PUBLICATIONS

Wikipedia Rules regarding "Beer Pong" Game, dated unknown.
Wikipedia Rules regarding "Flip Cup" Game, dated unknown.

*Primary Examiner* — John E Simms, Jr.
*Assistant Examiner* — Rayshun K Peng
(74) *Attorney, Agent, or Firm* — J. Gordon Lewis

(57) ABSTRACT

A portable game includes a lower table forming a circular playing surface and an edge having a diameter D1, an upper table forming a circular playing surface and an edge having a diameter D2, wherein D1>D2. A vertical support member interconnects the lower and upper tables. Both playing surfaces include an inner circular hub line extending about the center of the respective playing surfaces, and a plurality of radially directed rays formed on the respective playing surfaces. Each ray is circumferentially equally spaced from each immediately adjacent ray, wherein each pair of adjacent rays defines a trapezoidal play segment extending between the edge and hub line. An outer cup positioning marker is centrally formed in each play segment at a common radial distance from the edge, and an inner cup positioning marker is centrally formed in each play segment at a common radial distance from the hub line.

14 Claims, 11 Drawing Sheets

(56) References Cited

U.S. PATENT DOCUMENTS

| | | | | |
|---|---|---|---|---|
| 2005/0029747 | A1 | 2/2005 | Grayson | |
| 2005/0116413 | A1 | 6/2005 | Wagner | |
| 2006/0226606 | A1 | 10/2006 | Finley et al. | |
| 2007/0200293 | A1 | 8/2007 | Gomez et al. | |
| 2007/0298914 | A1* | 12/2007 | Allen | A47B 25/003 473/496 |
| 2011/0074112 | A1* | 3/2011 | Allen | F41J 1/10 273/407 |
| 2012/0169012 | A1* | 7/2012 | Parker | A63B 67/002 273/400 |
| 2013/0033004 | A1* | 2/2013 | Van Ness | A63F 3/00214 273/357 |
| 2014/0015197 | A1 | 1/2014 | Maffei et al. | |
| 2015/0031480 | A1* | 1/2015 | Kidd, III | A63B 63/00 473/478 |
| 2017/0259142 | A1* | 9/2017 | Reynolds, Jr. | A63B 63/08 |

* cited by examiner

PORTABLE TAILSPORTS GAME

TECHNICAL FIELD

The present invention is related to popular drinking games played on a table surface by two or more players. More particularly, the present invention relates to a table top assembly for playing ball games commonly known as Beer Fong, Flip Cup, Canoe, Batavia Downs, Survivor Flip Cup, Taps, Flippy Cup, Tippy Cup and the like.

BACKGROUND OF THE INVENTION

There are many types of drinking games that require the use of a planar playing surface, especially a table. Among these are games commonly referred to as "Beer Pong" and "Flip Cup".

In "Beer Pong" and its variants, cups containing a beverage, typically an alcoholic beverage, are placed near opposing ends of the play surface, in a configuration determined by the rules of the particular game. The game is played by two sides or teams, each side consisting of one or more players, but usually with an equal number of players on each side. The sides stand at the respective ends of the playing surface, behind one set of the cups. In turn, a player from each side attempts to propel an object, usually a ball, and typically a ping-pong or table tennis ball, from the team's end of the playing surface into one of the cups at the opposite end of the playing surface, causing it to come to rest therein. In some variants of the game, the object is thrown; in other variants of the game, the side on the offence has the opportunity to take two successive attempts.

Depending upon the particular set of rules adopted, the defending side may defend its cups. In one variation, no defense is permitted, yet in other variants, the defending side may use hands, a paddle, or the like. If the ball comes to rest in a defending side's cup, the, defending side must drink the contents thereof and the cup is removed from the playing field. When two balls are used and the offensive side is successful in landing both in the cups, the defensive side may be required to remove an additional cup from play and drink its contents. As cups are removed from play, some rule variations allow (or require) re-arrangement of the remaining cups. The side to remove all of the opponent's cups from the playing surface is the winner, and most rule variations require that the contents of any cups remaining on the winning side's end of the playing surface must be consumed by the losing side.

It is common to play the game of "Beer Pong" in a round-robin or elimination-type tournament, with many matches occurring In a venue on a number of playing surfaces. In such a format, the state of inebriation of members of each side may depend upon its success (or lack thereof) in prior matches.

The cups used in the game are usually of the disposable, plastic variety, typically with about a capacity of from about 10 to 16 liquid ounces. A typical material for such a cup is poly (ethylene terephthalate), sometime referred to as PETE. An amount of a beverage (usually 3 to 6 ounces) is added to each cup at the start of a game. Based upon a 12 ounce container (can or bottle), about 2 to about 5 cans or bottles will be imbibed per team per game to achieve this. A ping pong ball, with a nominal diameter of about 4 cm, will be about ½ of the diameter of the open end of the cup, so it is reasonably sized for the game. Also, with its light weight and density, the ping pong ball keeps spillage and splashing down from that which would occur with a denser ball.

The preferred playing field of known games is from about six to eight feet long, with a width in the range of about two to three feet. The cups are typically arranged within 18 inches from an end of the playing field, but usually no closer than about 4 inches from an end. As such, the typical playing field is slightly shorter in length than a conventional table tennis table, and about ½ as wide. The typical playing field is similar in shape and size to that of the surface of a door. The playing field is usually placed on a flat horizontal position about 29 inches off of the floor, that is, at the approximate height of a conventional table.

Until now, Beer Pong players have bad to play the game on a variety of makeshift playing fields, including kitchen tables, homemade platforms, and old doors, all of which prove to be inadequate. Since the size of the playing surface is not standardized and because it is not primarily intended for use in the game, the cups are not consistently thereon. This can unfairly affect the difficulty of the game. To promote fairness, it is important that the cups are placed in the same starting and regrouping positions on each end of the playing surface, and that this placement is consistent from game to game. It is therefore desirable for the game to be played on a surface that mandated the correct and consistent placement of cups.

A search of issued U.S. patents in the field of known drinking games and related apparatus reveals U.S. patents related generally to the field of the present invention but which do not anticipate nor disclose the device of the present invention. The discovered U.S. patents relating generally to the present invention are discussed herein below.

Published U.S. Patent Application No. 2005/0029747 A1 to Grayson entitled "Drinking Game Cup Holder" describes a drinking game cup holder that provides a plurality of cup-receiving openings. The holder places the cups within the holder in a correct relationship, but it does not provide a means for correctly positioning the cups at the opposite ends to each other. To this extent, the Grayson '747 published application exemplifies the fact that the game has been commonly played on a variety of make-shift playing fields.

Published U.S. Patent Application No. 2004/01889942 A1 to Trokan entitled "Non-Alcoholic Beer-Pong Game/System" describes a non-alcoholic drinking game system, but the invention is concerned with the game rules and physical properties of the balls used in the game. While Trokan '942 published application discloses the triangular arrangement of the drinking cups used and the general size of the playing field used, it does not describe the playing field particularly adapted for use with the game.

"Flip Cup" is another drinking game that is played in many of the same venues as "Beer Pong". In "Flip Cup", two opposing teams line up across from each other at a table. Each player has a cup, filled with a beverage. Starting at one end of the table, the first player on each team consumes the beverage in his cup and places the emptied cup, upright, along the table edge, with a portion of the cup bottom extending over the edge. The player strikes this portion of the cup bottom from below, attempting to flip the cup into an upside down position on the table. If the attempt is unsuccessful, the player places the cup again and repeats the flip attempt until successful. The game proceeds in the manner of a relay race, with each team member starting only after the prior team member has succeeded. The first team to successfully drink and flip all of its cups is the winner.

As with Beer Pong, Flip Cup can become very messy due to inadvertent spillage. The ability to contain such spillage on the table is desirable. Even in a commercial drinking establishment, it is desirable to have a portable playing surface for playing games such as Beer Pong and/or Flip Cup, so that the playing surface may be readily moved for cleaning and be readily stowed away when not in use.

It is therefore an unmet advantage for the prior art to provide a compact and portable standardized playing surface for drinking games such as Beer Pong and/or Flip Cup that is readily portable and easily cleaned after use.

None of the above listed U.S. patents applications disclose or suggest an omni-directional and/or multi-level beer pong gaming surface of the present invention. Each of the above listed U.S. patents applications (i.e., U.S. 2005/0029747 A1; and U.S. 2004/0188942 A1) are hereby incorporated herein by reference.

SUMMARY OF THE INVENTION

The forgoing problems and limitations are overcome and other advantages are provided by a new and improved beer pong gaming table which provides flexibility and user convenience when setting up and storing in inconvenient and confined venues.

Therefore, it is an object of the present invention to provide a novel beer pong gaming table system.

The present invention provides a multi-level table game assembly comprising a lower table forming a substantially circular upwardly facing playing surface and a circumferentially continuous outwardly facing edge having a nominal diameter D1, an upper table forming a substantially circular upwardly facing playing surface, a bottom surface and a circumferentially continuous outwardly facing edge having a nominal diameter D2, wherein D1>D2, a vertically elongated support member rigidly interconnecting the upper and lower tables, wherein playing surfaces each define discrete play segments and cup positioning markers. This arrangement provides an extremely compact game assembly suitable for tailgate venues and the like.

According to one aspect of the invention, a table game assembly includes a table forming a substantially circular upwardly facing playing surface and a circumferentially continuous outwardly facing edge, an inner circular hub line extending about the axial center of said playing surface, a plurality of radially outwardly directed rays formed on said playing surface, each said ray circumferentially equally spaced from each immediately adjacent ray, wherein each pair of adjacent rays defines a generally trapezoidally shaped play segment extending from said edge to said hub line, an outer cup positioning marker centrally formed in each play segment at a common radial distance from said edge, and an inner cup positioning marker centrally formed in each play segment at a common radial distance from said hub line.

According to another aspect of the invention. A table game assembly comprises a first table forming a substantially circular upwardly facing playing surface and a circumferentially continuous outwardly facing edge having a nominal diameter D1, a second table forming a second substantially circular upwardly facing playing surface, a bottom surface and a circumferentially continuous outwardly facing edge having a nominal diameter D2, wherein D1>D2, a vertically elongated support member rigidly interconnecting the first table playing surface with the second table bottom surface, said first and second playing surfaces each including an inner circular hub line extending about the center of said respective playing surface, said first and second playing surfaces each including a plurality of radially outwardly directed rays formed on said respective playing surfaces, each said ray circumferentially equally spaced from each immediately adjacent ray, wherein each pair of adjacent rays defines a generally trapezoidally shaped play segment extending from said edge to said hub line, an outer cup positioning marker centrally formed in each play segment at a common radial distance from said edge, and an inner cup positioning marker centrally formed in each play segment at a common radial distance from said hub line.

According to yet another aspect of the invention, the table game assembly further comprises at least one open topped drinking container including a side wall and a generally circular bottom wall, wherein said bottom wall has a nominal diameter of D, wherein said outer cup positioning marker within a given play segment is located radially from said edge by a dimension R, and wherein D>R. This arrangement ensures that cups positioned to ensure that they overlap the outer edge of the table edge, allowing playing "Flip Cup" simultaneously with "Beer Pong"

These and other features and advantages of this invention will become apparent upon reading the following specification, which, along with the drawings, describes preferred and alternative embodiments of the invention in detail.

BRIEF DESCRIPTION OF THE DRAWINGS

The present invention will now be described, by way of example, with reference to the accompanying drawings, in which.

Although the drawings represent embodiments of the present invention, the drawings are not necessarily to scale and certain features may be exaggerated in order to illustrate and explain the present invention. The exemplification set forth herein illustrates an embodiment of the invention, in one form, and such exemplifications are not to be construed as limiting the scope of the invention in any manner.

DESCRIPTION OF THE PREFERRED EMBODIMENTS

The present invention, although conceivably useful indoors, is primarily intended for outdoor use. Specifically, it is intended for outdoor venues such as athletic contests (e.g. football games) where large groups of spectators gather in a celebratory atmosphere. "Tailgating" is a tradition at such events where fans congregate to eat, drink and socialize (e.g., play team-type games) prior to athletic contest.

The preferred embodiment is described for use in conjunction with attendance at a football game, and particularly for games involving a particular sports team. To this end, it can include team specific features such as logos, team colors, mascot persona, and the like. Such features are included for exemplary purposes only.

Figure 1:
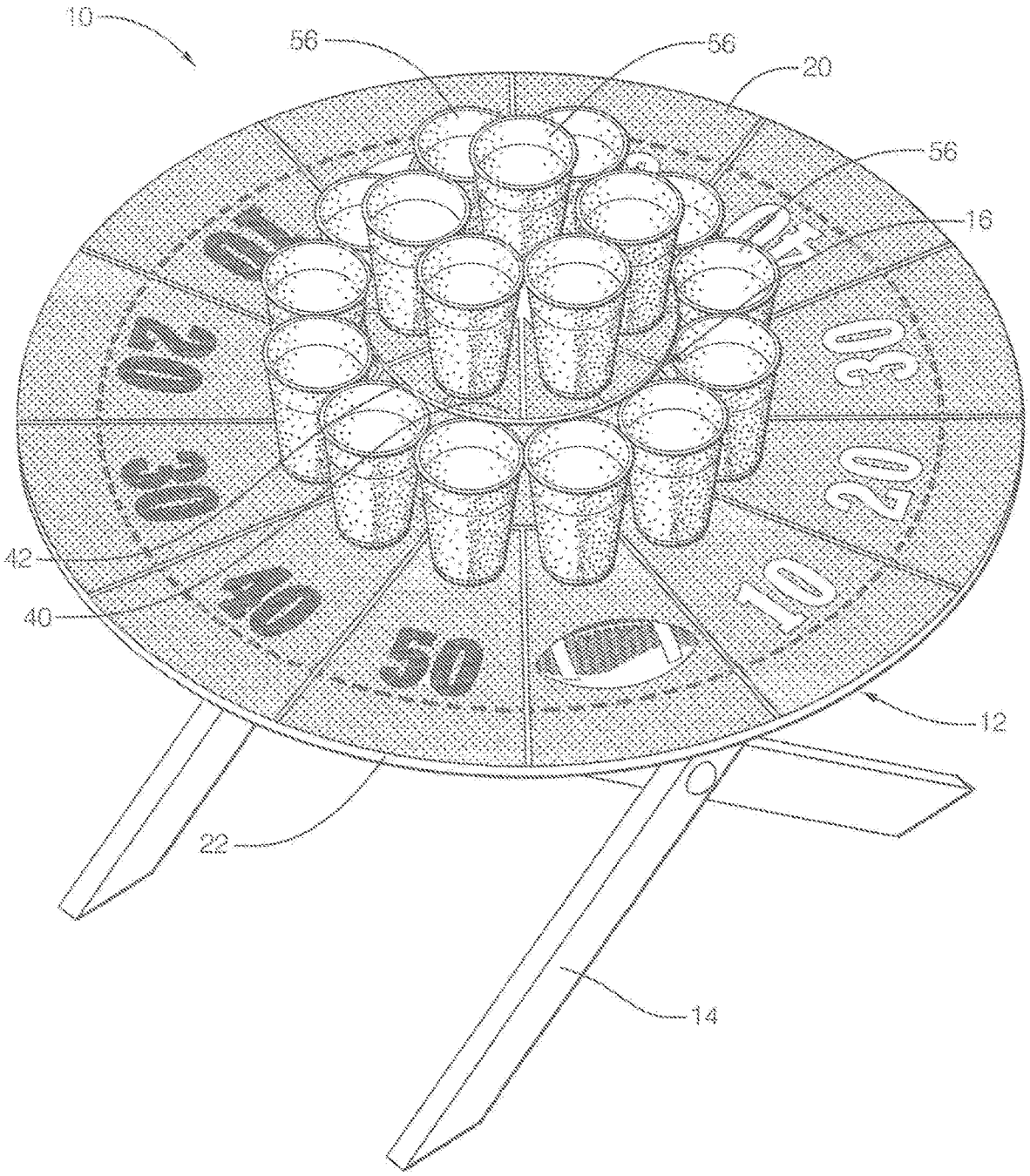
FIG. 1, is a downwardly directed perspective view of a reconfigurable TailSports game table assembly embodying the present invention, deployed for a "Tail Pong" game, the TailSports game table assemble including a one-piece lower or main table portion supported on a folding leg structure, an upper table portion symmetrically supported above the lower table portion by centered pedestal, and a plurality of beverage glasses prepositioned on designated upper surface areas of both the main and upper table portions.
Figure 8:
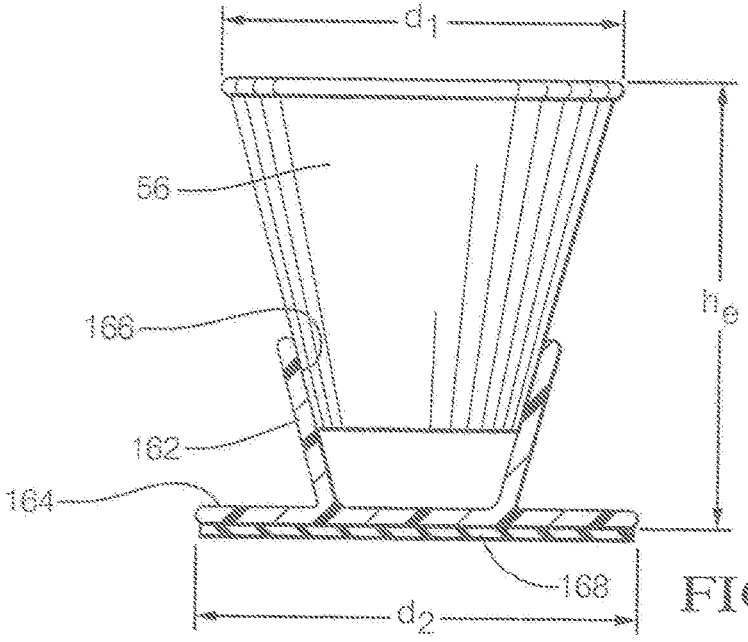
FIG. 8, is a cross-sectional view of a cup height extender which can be employed to selectively vertically position and affix a game cup to the upper or lower table portions of the TailSports game table assembly with certain game configurations.
Figure 9:
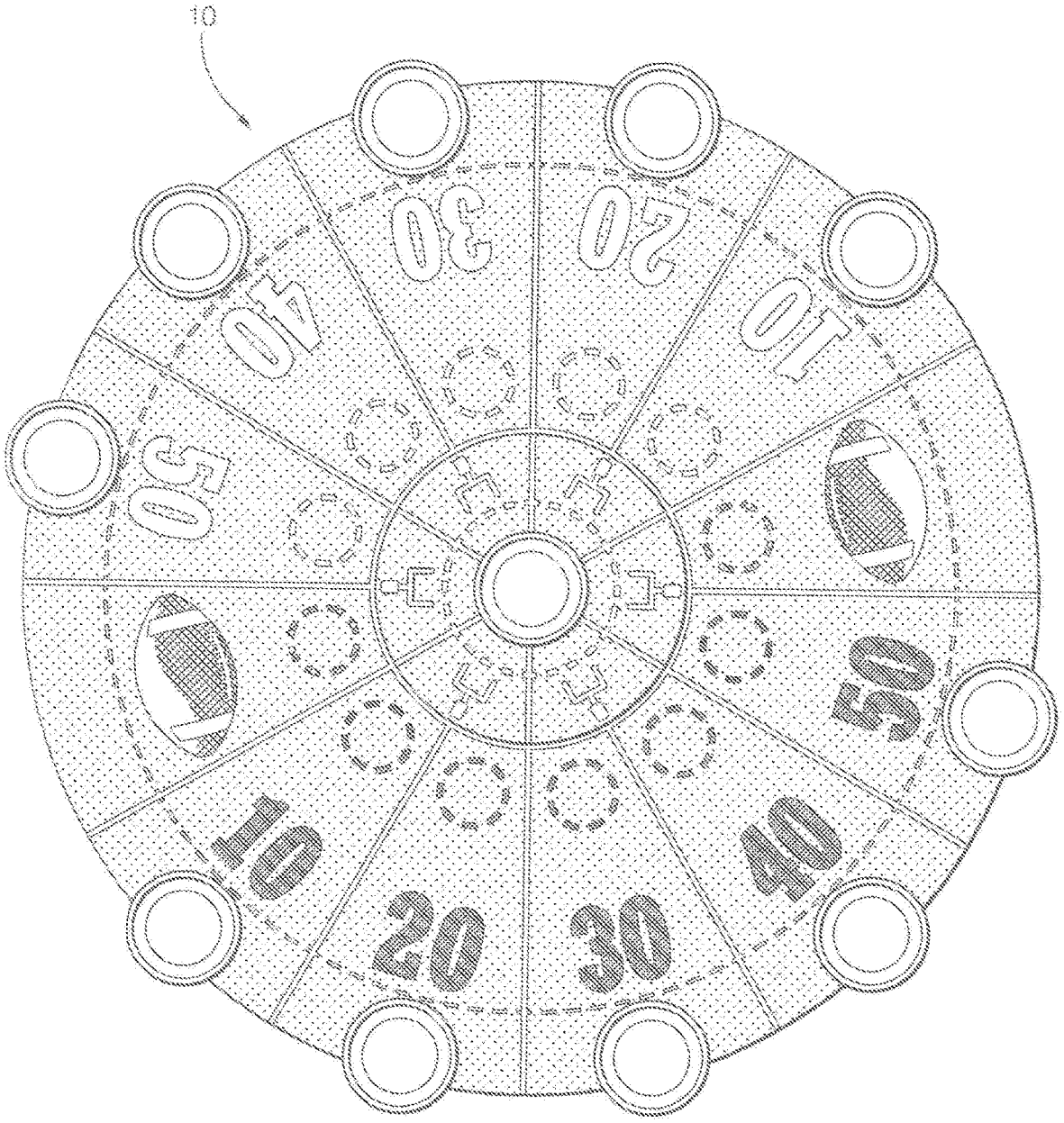
FIG. 9, is a top plan view of the TailSports game table assembly of FIG. 1 with the game cups initially arranged for a first game sequence.

Referring to the drawing figures, and particularly to FIGS. 1, 8 and 9, a preferred embodiment of a game tank assembly (in use) in accordance with the present invention is illustrated in perspective view and is generally designated by the reference numeral 10.

Figure 2:
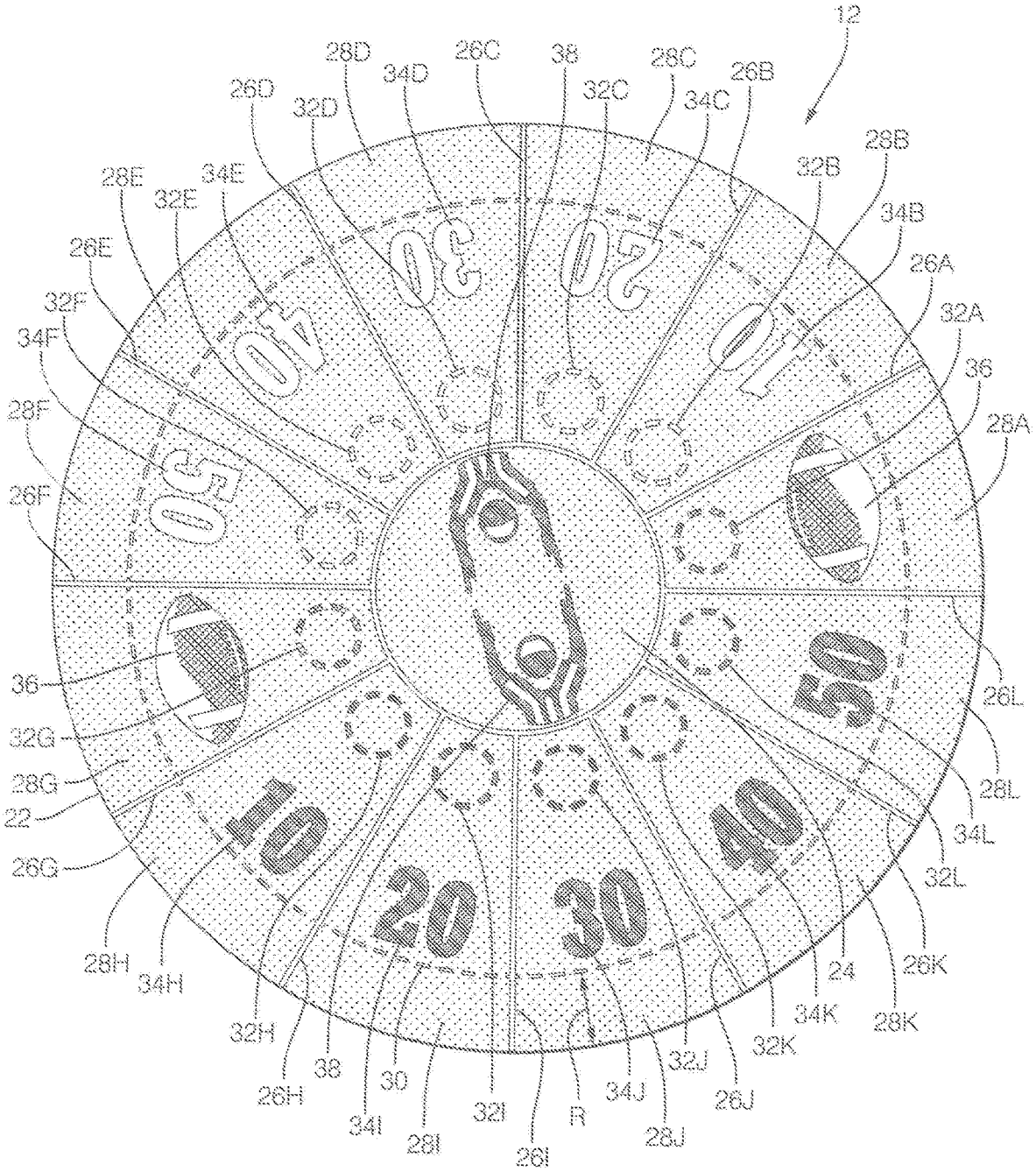
FIG. 2, is a top plan view of the lower table portion of the TailSports game table assembly of FIG. 1 on an enlarged scale.
Figure 3:
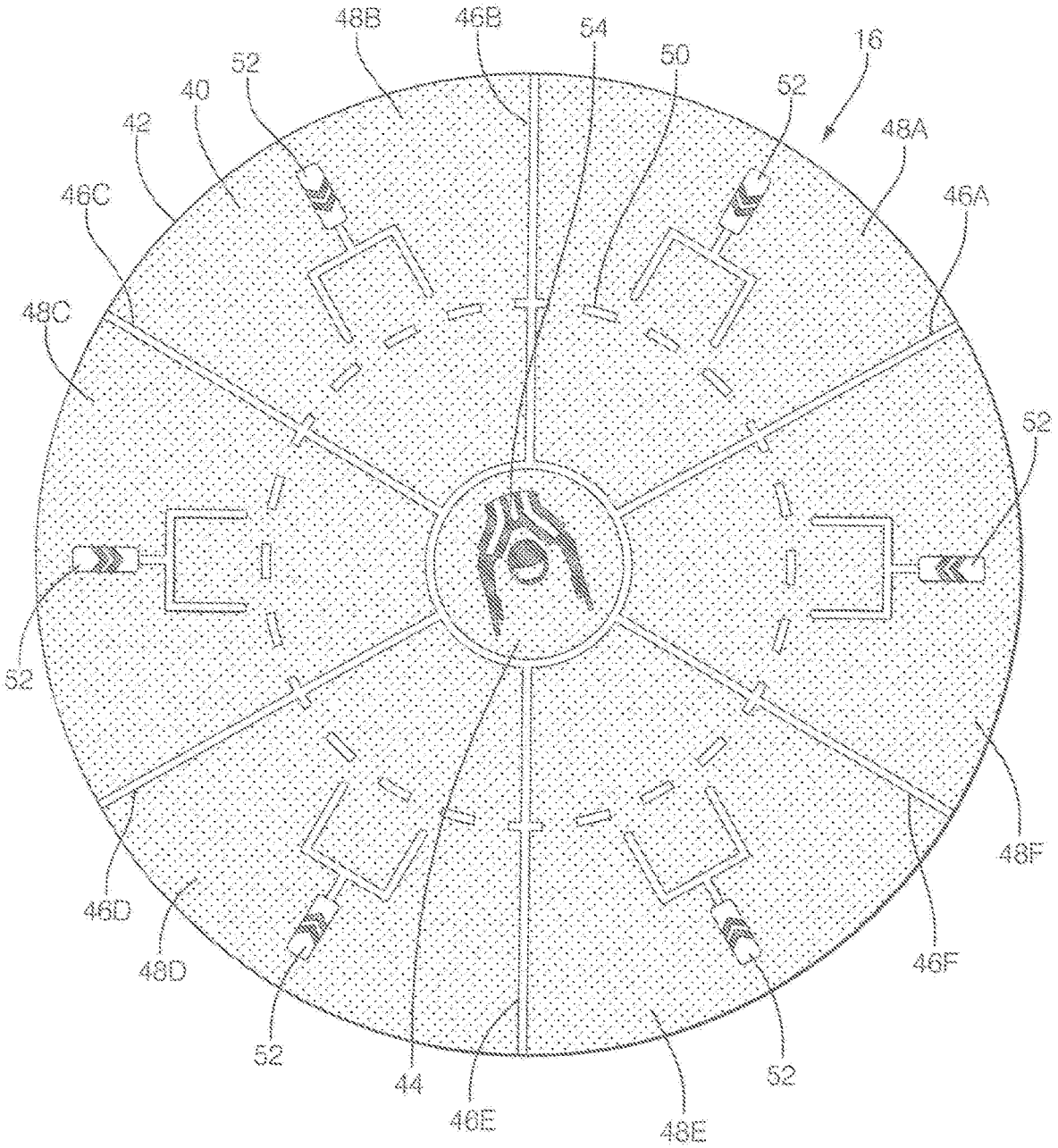
FIG. 3, is a top plan view of the upper table portion of the TailSports game table assembly of FIG. 1 on a still further enlarged scale.

Referring to FIGS. 1-3, a first embodiment of a game table assembly 10 includes a first or bottom table 12 supported on a folding leg assembly 14 affixed to the lower surface (not illustrated) thereof. A second or top table 16 is arranged concentrically above the bottom table 12 and is retained in a fixed position by a vertically elongated support member (not illustrated). The tables 12 and 16 can be fabricated from composite material such as plywood which is subsequently painted, but preferably are injection or blow molded from plastic with the artwork integrated therein.

FIG. 2 illustrates the detail of the playing surface 20 of the bottom table 12, which is decorated and colored in a football motif. The design can be altered depending upon the activity, sport, team or the like. The bottom table 12 is round and 36 inches in diameter ($D_1$) and forms a circumferentially continuous outwardly facing edge 22. The playing surface 30 is illustrated in a green color with a circular hub 24 defined by a concentric line. Twelve equally spaced circumferential radial lines or rays 26A-26L extend from the hub 24 to the outer edge 22. Each adjacent pair of rays 26A-26L are angularly offset by 30°, Rays 26A-26L and captured portions of the hub 24 and outer edge 22 define twelve equally dimensioned trapezoidally shaped play segments 28A-28L. An outer cup positioning marker 30 is illustrated as a dotted circle concentric with the playing surface 20 located inwardly from the outer edge 22 by a radial dimension R which is less that the nominal diameter D of the bottom of a cup employed in a game to ensure that a portion of the cup extends radially outwardly beyond the outer edge 22. An inner cup positioning marker 32A-32L is illustrated is a small dotted circle centrally disposed within each play segment 28A-28L located radially outwardly from the central hub 24.

Play segments 28B-28F segments are reserved for Team 1, play segments 28H-28L are reserved for Team 2 and play segments 28A and 28G provide an unused tree space between the teams. Scaled indicia such as white colored consecutive yardage marker designations "10", "20", "30", "40" and "50", 34B, 34C, 34D, 34E, and 34F, respectively, are disposed within associated play segments 28B-28F, respectively. Similarly, scaled indicia such as black colored consecutive yardage marker designations "10", "20", "30", "40 " and "50" are disposed within associated play segments 28H-28L, respectively. Game themed indicia such as footballs 36 are disposed within play segments 28A and 28G. Game themed indicia such as stylized referee FIGS. 38 are disposed within the circular hub 24.

FIG. 3 illustrates the detail of the playing surface 40 of the top table 16, which is decorated and colored in a football motif. The design can be altered depending upon the activity, sport, team or the like. The top table 12 is round and 12 inches in diameter (D2) and forms a circumferentially continuous outwardly facing edge 42. The playing surface 40 is illustrated in a green color with a circular hub 44 defined by a concentric line. Six equally spaced circumferential radial lines or rays 46A-46F extend from the hub 44 to the outer edge 42. Each adjacent pair of rays 46A-46L are angularly offset by 60°. Rays 46A-46L and captured portions of the hub 44 and outer edge 42 define six equally dimensioned trapezoidally shaped play segments 48A-48F. An outer cup positioning marker 50 is illustrated as a dotted circle concentric with the playing surface 40 located inwardly from the outer edge 42. Circular hub 44 defines an inner cup positioning marker illustrated is a small solid circle.

Play segments 48A-48C segments are reserved for Team 1, and play segments 48D-48F are reserved for Team 2.

Game themed indicia such as goalposts 52 are disposed within each play segment 48A-48F. Game themed indicia such as a stylized referee FIG. 54 is disposed within the circular hub 44.

Once the game table assembly 10 is assembled as illustrated in FIG. 1, each ray 46 of the top table 16 aligns in parallel with every other ray of bottom table 12. For example, if upper ray 46A is aligned with lower ray 26A, upper ray 46B will align with lower ray 26C, upper ray 46C will align with lower ray 26E, upper ray 46D will align with lower ray 26G, upper ray 46E will align with lower ray 26I, and upper ray 46F will align with lower ray 26K. Restated, when so aligned, upper play segment 48A encompasses and is thus part of both lower play segments 28B and 28C, upper play segment 48B encompasses and is thus part of both lower play segments 28D and 28E, upper play segment 48C encompasses and is thus part of both lower play segments 28F and 28G, upper play segment 48D encompasses and is thus part of both lower play segments 28H and 28I, upper play segment 48E encompasses and is thus part of both lower play segments 28J and 28K, and upper play segment 48F encompasses and is thus part of both lower play segments 28L and 28A. The forgoing juxtaposition of the bottom table 12 and the upper table 16 is best illustrated in FIGS. 8 and 9.

Referring to FIG. 1, a number of disposable plastic cups 56 are employed in various numbers and configurations for the games described herein. Examples of two specific alternative configurations are illustrated in FIGS. 8 and 9.

The most common cups used are 18 fluid ounce (530 ml) disposable plastic cups 54 (such as red Solo brand cups) with ridge-lines which can be used precisely to measure the amount of beverage (beer) to be poured into the cup. Prior to commencing a game, cups are positioned on each play segment 28A-28L on play surface 20 and 48A-48F on play surface 40. Each team usually also has a separate cup of water used to rinse off the balls.

Although 18 ounce cups 56 are very common in games of this nature, other sized disposable cups, as listed below, can be employed:

| CUP VOLUME (oz.) | HEIGHT | RIM DIA. | BASE DIA. (all in.) |
|---|---|---|---|
| 18 | 4.750 | 3.750 | 2.500 |
| 14 | 4.500 | 3.375 | 2.375 |
| 12 | 4.500 | 3.250 | 2.375 |
| 9 | 3.750 | 3.000 | 1.875 |
| 5 | 2.750 | 2.500 | 1.750 |
| 2 | 2.125 | 2.000 | 1.250 |

Because different sized cups 56 may be employed for various games and circumstances, the configuration of the outer cup positioning markers 30 and 50, and the inner cup positioning markers 32 and 44 can be varied. Because differing base diameter cups may be employed, a plurality of concentric or non-concentric circles (solid, dotted or otherwise) such as a shooting target can be employed to assist precise location of cups 56.

Figure 4:
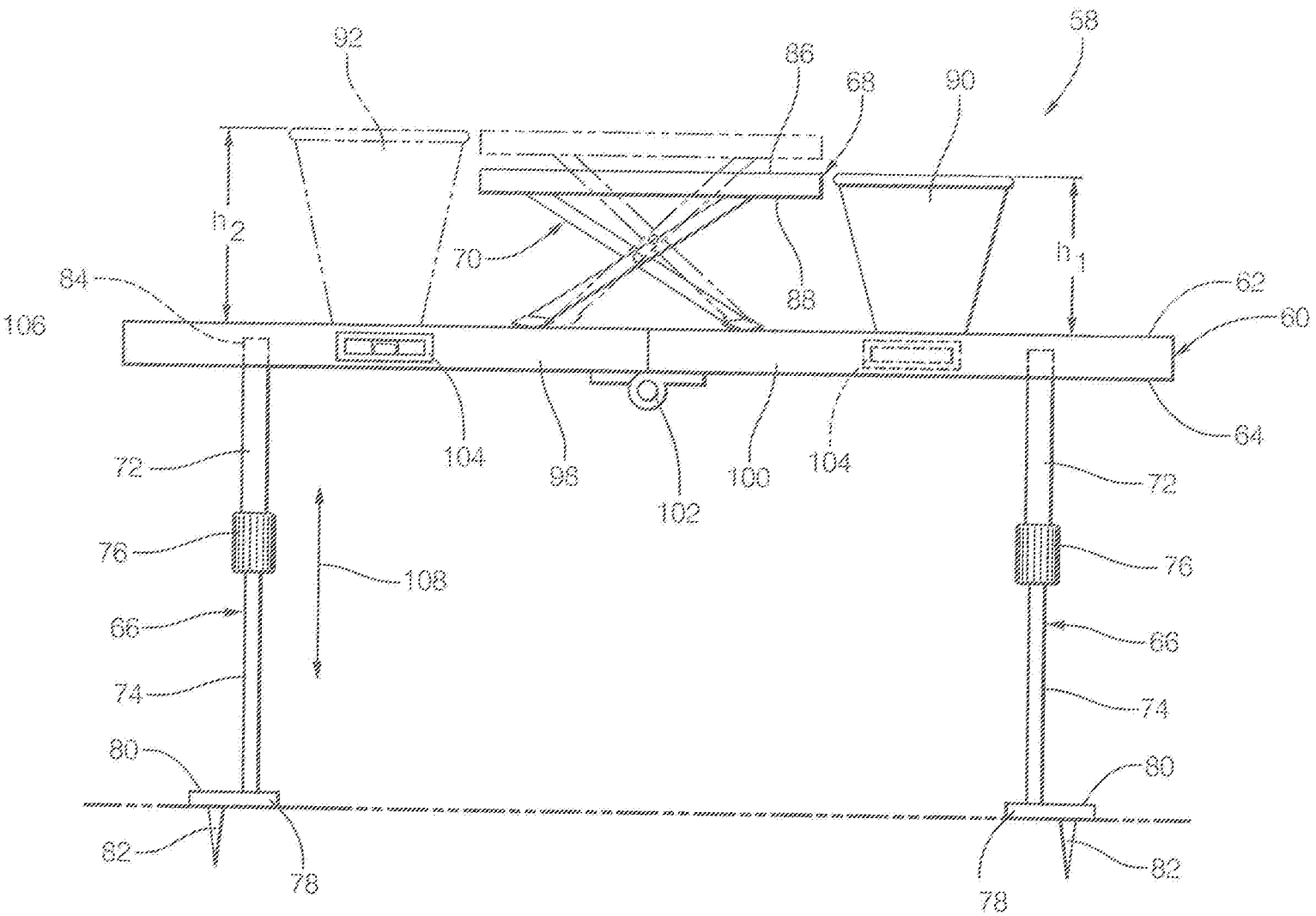
FIG. 4, is a side plan view of a reconfigurable TailSports game table assembly including an alternative embodiment of the present invention, featuring a bi-foldable lower table portion supported upon discrete vertically adjustable ground staking legs and an infinitely adjustable scissors frame interconnecting the lower and upper table portions.

Referring to FIG. 4, an alternative embodiment of the present invention includes a game table assembly 58 including a first or bottom table 60 having an upper playing surface 62 and a bottom surface 64. The game table assembly 58 is supported by a plurality (preferably 4) of tubular legs 66 circumferentially equally spaced about the perimeter of the bottom table 60. A second or top table 68 having an upper playing surface 86 and a bottom surface 88 is supported above the bottom table 60 by a scissors spacer or adjuster 70 which is infinitely or incrementally adjustable within a fixed range of displacement. As illustrated, the upper playing surface 86 of the top table 68 is positioned above the upper playing surface 62 of the bottom table 60 by a vertical dimension $h_1$ corresponding with the nominal height of a cup 90 employed in a game. If a larger cup having a greater nominal height is to be employed in a game, the scissors adjustor 68 is reconfigured wherein the upper playing surface 86 of the top table 62 is positioned above the upper playing surface 62 of the bottom table 60 by a vertical dimension $h_2$ corresponding with the nominal height of a taller cup 92.

As an alternative to the scissors adjuster 70, a fixed length or adjustable free-standing column can be applied to interspace the top table 68 above the bottom table 60.

The bottom table is bifurcated onto two mirror image halves 98 and 100 joined by a piano type elongated hinge 102. At least one spirit level device 104 is integrated within the outer edge 106 of the lower table to facilitate set-up of the game table assembly 38 on even ground. Preferably two such spirit level devices 104 are circumferentially offset by 90° to enable two-axis leveling.

Each tubular leg 66 includes an upper tube portion 72 telescopingly disposed within a lower tube portion 74 and selectively engaged by a clinching collar 76. Each leg 66 is removably connected to the bottom surface 64 of table 60 wherein the upper end of each upper tube 72 is slip fit or screwed within a blind bore opening 84 (illustrated in phantom) formed in the bottom surface 64 of the bottom table 60. The lower end of lower tube 74 terminates in a foot 78 forming an outwardly extending offset 80 and a ground engaging spike 82. The axial length of each leg 66 can be separately adjusted, as illustrated by arrow 108, to accommodate uneven ground.

Figure 5A:
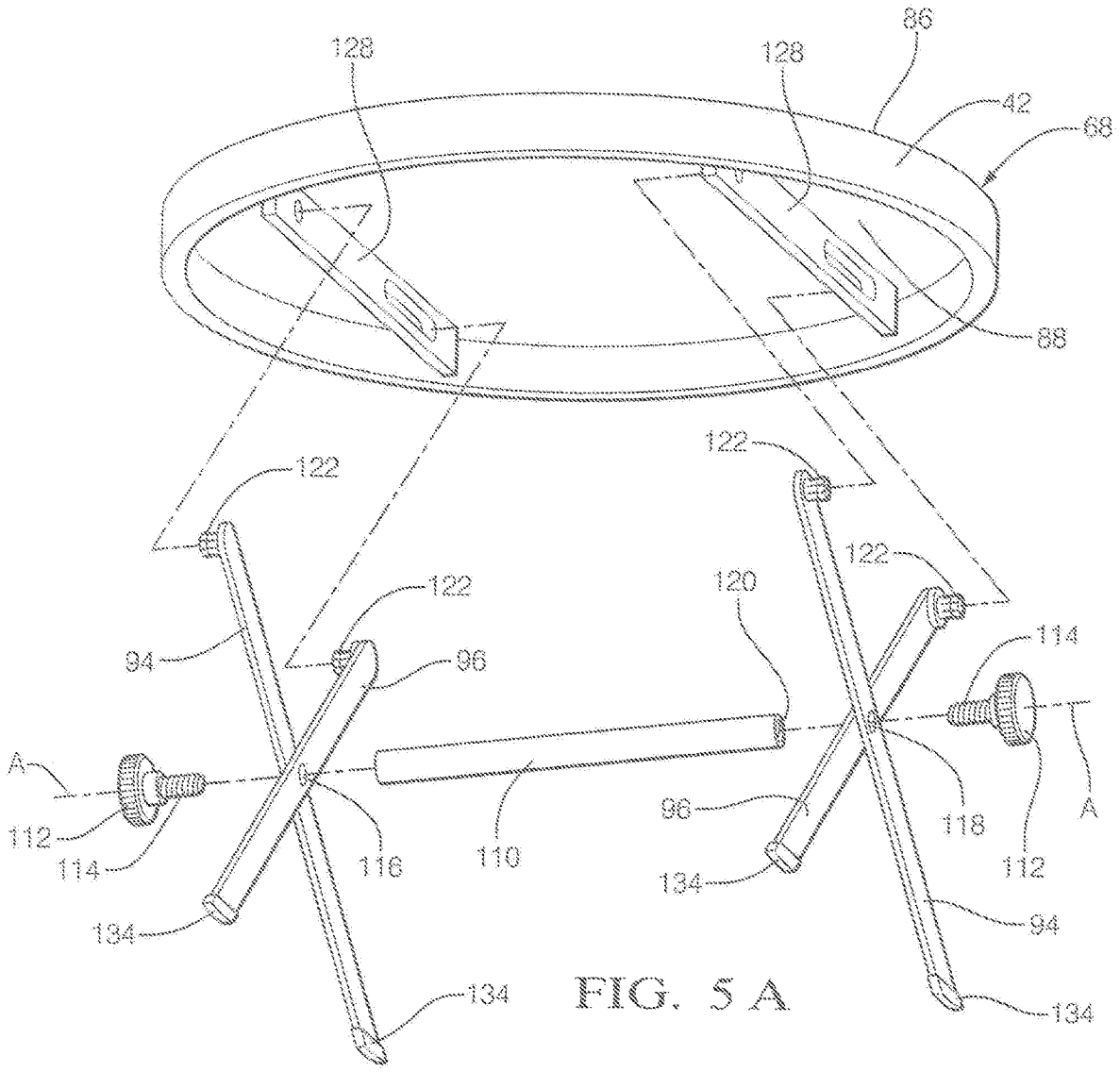
FIG. 5A, is an exploded perspective view of the an infinitely adjustable scissors frame and upper table of FIG. 4 on an enlarged perspective.
Figure 5B:
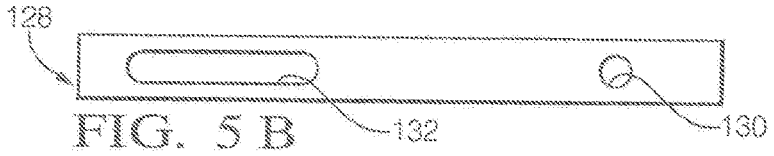
FIG. 5B, is side view on an enlarged scale of a subframe integrated or interfit on the bottom of the upper table of FIG. 5A enabling infinite adjustability of the scissors frame within a limited range.
Figure 5C:
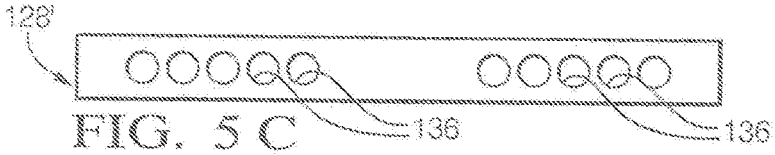
FIG. 5C, is side view on an enlarged scale of an alternative design subframe integrated or interfit on the bottom of the upper table of FIG. 5A enabling coarsely stepped adjustabdily of the scissors frame within a limited range.
Figure 5D:
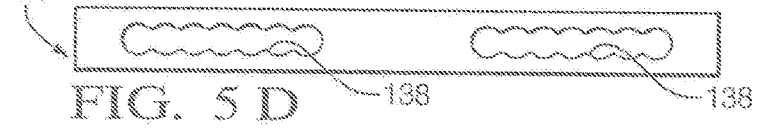
FIG. 5D, is side view on an enlarged scale of a second alternative design subframe integrated or interfit on the bottom of the upper table of FIG. 5A enabling finely stepped adjustability of the scissors frame within a limited range.
Figure 5E:
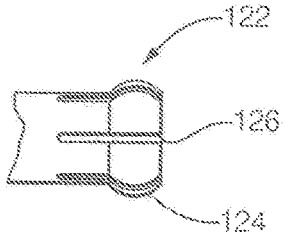
FIG. 5E, is a broken plan view, on an enlarged scale of an exemplary radially resilient connector integrally formed near the end of each scissors frame element retentively interconnected within an opening of a subframe of the upper table.

Referring to FIGS. 5A, 5B and 5E, a scissors type adjustable spacer 70 includes two pairs of elongated struts 94 and 96, each pair juxtaposed in an "X" configuration and for rotation about a central axis A-A. The pairs of struts 94, 96 are axially separated by a tubular spacer 110 and held in assembly by opposed hand tightening knobs 112 having opposed threaded shafts 114 extending through thru bores 116 and 118, and threadably engaging a threaded center shaft 120 of spacer 110.

An outwardly projecting pivot extension 122, as detailed in FIG. 5E, is integrally formed adjacent the upper end of each strut 94, 96. Each pivot extension 122 is generally tubular in form, terminating in a bulbous end portion 124 which is circumferentially segmented by a plurality of axial slots 126 affording radial resilience.

Referring to FIGS. 5A and 5B, a support bracket 128, associated with each scissors adjuster 70, is located along the bottom surface 88 of the top table 68 and entrained by the inner surface of the outer edge 42 of the top table 68. Each support bracket 128 is elongated and has a thru bore 130 and a thru slot 132 formed at opposed ends thereof. Each scissors adjuster 70 is assembled with an associated support bracket 128 by extending its pivot extensions 122 through the bore 130 and slot 132. The bulbous end portion 124 has a nominal diameter slightly larger than the diameter of the thru bore 130 and slot 132 requiring temporary resilient deflection of the segments to enable assembly. Thereafter, the struts 94 and 96 are selectively rotationally repositioned to affect the desired vertical height of the combined scissors adjuster 70 and top table 68. When so positioned, the knobs 112 are tightened to affix the scissors adjuster 70 in their desired configurations.

The lower end of each strut 94, 96 preferably includes a resilient (e.g., rubber) cleat or foot 134 to provide tactile adhesion with the playing surface 62 of the bottom table 60 without marring during usage. Alternatively, a form of mechanical interconnection of the struts 94, 96 to the upper (playing) surface of the lower table 60 can be implemented.

Referring to FIG. 5C, a series of spaced apart thru holes 136 are formed adjacent each end of the support bracket 128' providing coarse incremental adjustability. Referring to FIG. 5D, a series of overlapping thru holes 138 are formed adjacent each end of the support bracket 128" providing relatively fine incremental adjustability.

The major components of the game table assembly 58 are preferably formed of lightweight rigid material, such as fiberglass or vacuum formed plastic. The support brackets 128 can be discrete elements or, alternatively, can be integrally formed with their associated top table 68.

The bottom table 60 is dimensionally identical to bottom table 12 and the playing surface 62 is as described in connection with FIG. 2. The top table 68 is dimensionally identical to bottom table 16 and the playing surface 62 is as described in connection with FIG. 3.

Figure 6:
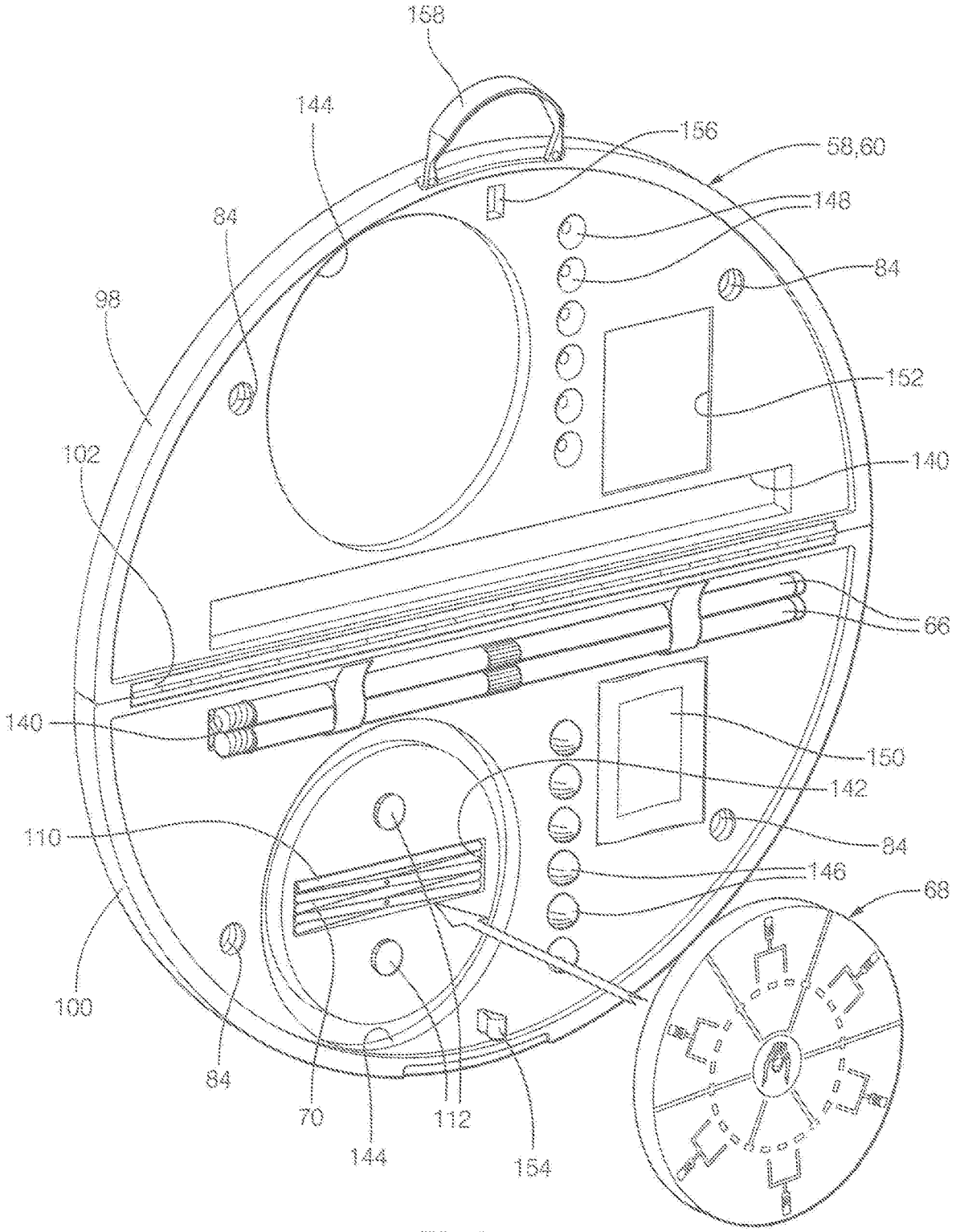
FIG. 6, is an exploded, perspective bottom view of the reconfigurable TailSports game table assembly of FIG. 4 on an enlarged scale illustrating additional features including internal stowage of the upper table portion, game balls, the scissors frame and the lower table legs within the lower table portion.

Referring to FIG. 6, the game table 58 is illustrated with each discrete or removable element disassembled and stowed in associated retention pockets formed in the bottom surface 64. Specifically, the four legs 66 are removed from their blind bores 84, collapsed to a minimum axial length, bundled and stowed within an elongated recess 140. Note that the foot 78 and spike 82 structure are not illustrated for the purpose of clarity in FIG. 6. The scissor adjusters 70, support brackets 128, tubular spacer 110 and knobs (2) 112 are separated and stowed in associated retention pockets 142. The top table 68 is stowed within an associated round recess 144. Individual ping pong balls 146 are stowed within separate retention pockets 148. Lastly, a rule book—instruction manual 150 is stowed within a retention pocket 152. Note that designated recesses 140, 144, 148 and 152 are mirrored in clam shell fashion in table halves 98 and 100.

Figure 7:
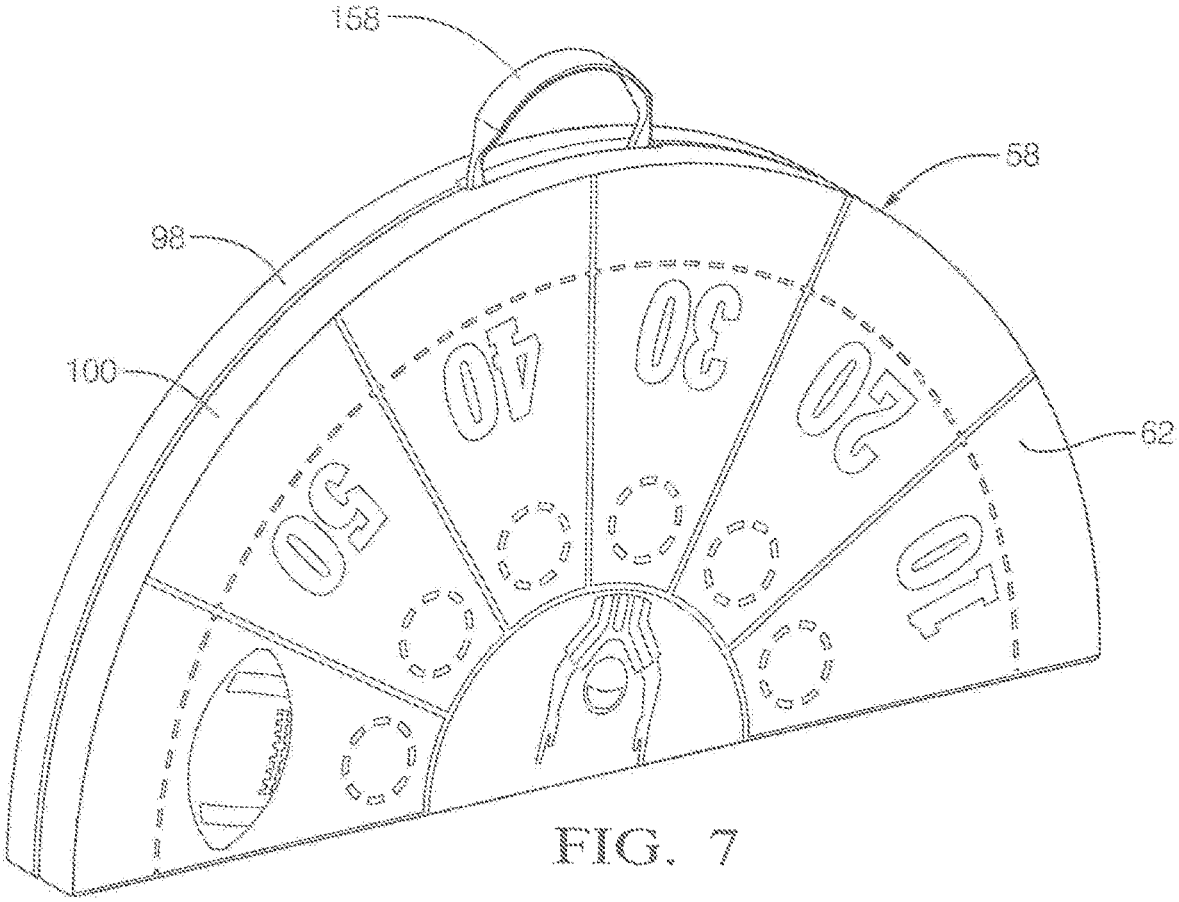
FIG. 7, is a perspective view of the game assembly of FIG. 6 in the fully folded configuration for stowage and/or transportation to a game venue.

The bottom table 60 also forms a cooperating latch 154 and catch 156, to retain the table 60 in a closed position as illustrated in FIG. 7, and a carrying handle 158. For additional protection, the game assembly 58 can be provided with a zippered cover carrying case (not illustrated).

Referring to FIG. 8, for game configurations, such as illustrated in FIG. 1, the cup 56 positioned in the center of the top table 16 within the circular hub 44 is elevated above the surrounding cups 56 adjacent the outer cup positioning marker 50. This is accomplished by employing a cup height extender 160 comprising an upwardly opening cylindrical wall 162 and an integral radially outwardly extending flanged base 164. The cylindrical wall 162 defines an inner wall surface 166 which is tapered at substantially the same pitch as the nominal outer wall of the intended cup 56. This effectively increases the effective height (he) of the cup 56 (approximately 3 inches) while maintaining its standard lip diameter (d1) and provides extremely robust retention of the cup 56, even when filled with a liquid. The flanged base 164 has a flat bottom, with an effective nominal diameter (d2). Stability if the elevated cup 56 can be further enhanced by the addition of an adhesive or tactile layer 168. This feature provides a third level (of lips of cups in play).

The basic rules of two exemplary games: Game 1: Tail Pong and Game 2: Race Pong are as follows.

TAIL PONG RULES:

The object of the game is to finish each task in order before the opposing team finishes their task.

Each team is made up of 1-5 players

First Sequence:

(A.) You start by lining your Solo cup 56 face up on the outside of the dotted circle 30 filled with ⅓ liquid as illustrated in FIG. 9.

(B.) The game starts with the first person on each team at the 10 yard line 28B and 28H.

(C.) The first person drinks the contents of their cup 56, and then places the cup down on the edge 22 of the table 20.

(D.) The player then flips over the "flip cup" until the cup 56 lands on its lip/top. The next player will only get to their turn once each subsequent player finished their task and so on.

(E.) When each player on your team drinks the contents of their cup 56, then flips the cup 56 over with the lip landing on the table 20, the team then advances to their next task.

Figure 10:
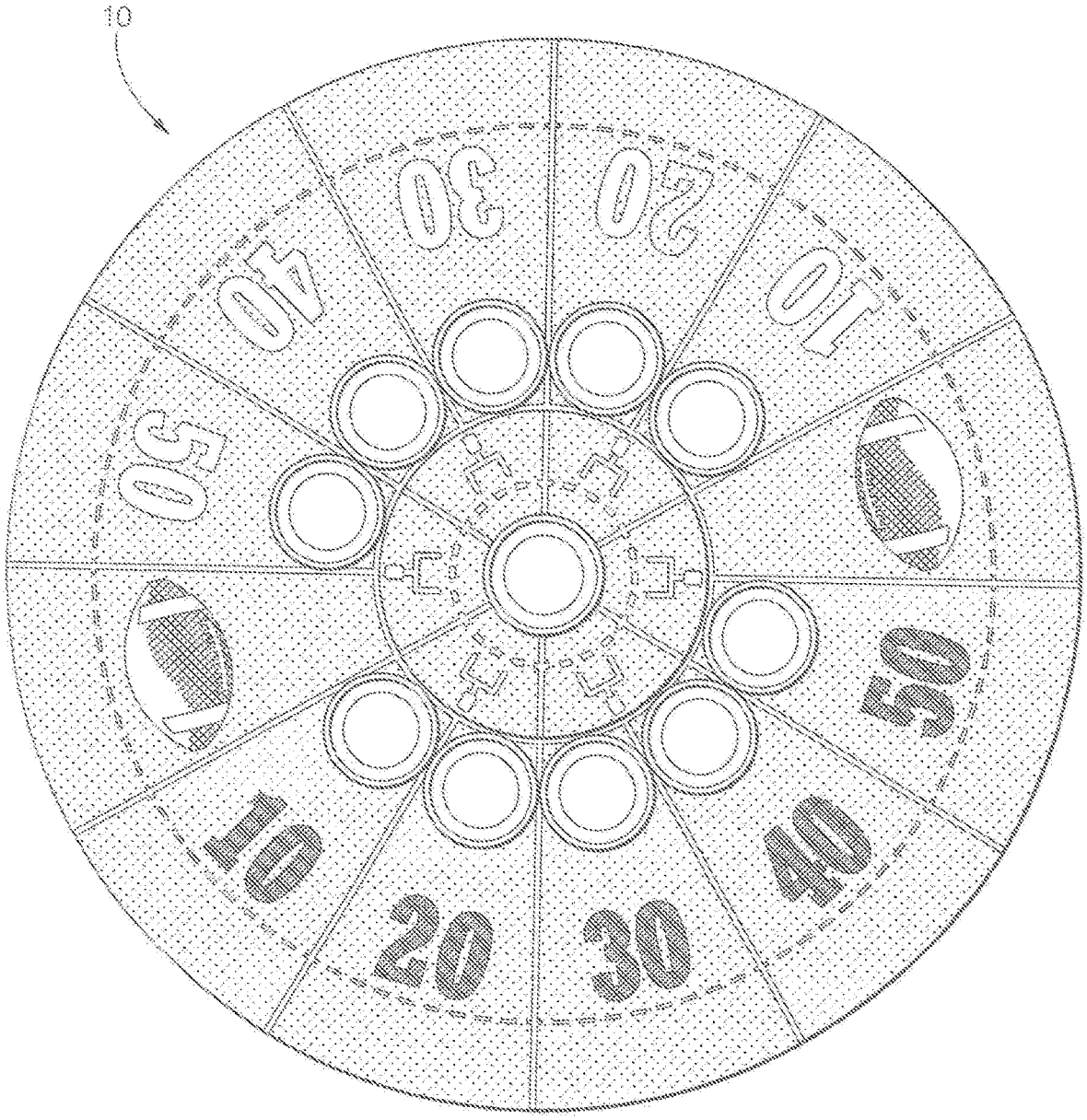
FIG. 10, is a top plan view of the TailSports game table assembly of FIG. 1 with the game cups initially arranged for a second and third sequence game.

Second Sequence:

(A.) Each player, lines their cup 56 up on the inside circle 32 as illustrated in FIG. 10.

(B.) Once the cups 56 are lined up on the inside circle 32, the person starting at the 10 yard line 28B or 28H takes a ping-pong hall 146 and bounces the ping-pong ball 146 into their cup 56. Once the player bounces the ping-pong ball 146 into the cup 56, the next player in line will do the same and so on.

Third Sequence:

(A.) When all of the players achieve getting the ping-pong ball 146 in their cups in sequence, the ping pong ball 146 is given back to the first player at the 10 yard line 28B or 28H.

(B.) The first player, then attempts to bounce the ping-pong ball 146 from the first level to the second level into the top cup 56. If this player does not get the ping-pong ball 146 into the top cup 56, the ping-pong ball 146 will be given to the next player in line for their chance at bouncing the ping-pong ball 146 into the cup 56. Once one of the teams finishes their entire task and one of the teams bounces the ping pong ball 146 into the top center cup 56. The person on the opposing team whom is in play "bouncing their ping-pong ball 146" will have to drink the entire contents of the top center cup 56.

RACE PONG RULES (A.) Divide into two equal teams from 1 to 5 people.

(B.) Fill up each cup 56 with about ⅓ drink and 1 cup 56 in the center top full of drink.

(C.) The first person at the 50 yard line 28F or 28L starts the game.

(D.) You start the game by drinking the ⅓ drink, then flipping the cup 56 over and having it land on its rim, face down. Once your cup 56 is successfully flipped over, the team member to your left at the next lower yard line drinks their drink and flips their cup 56 over, and so on.

(E.) Once all the cups 56 on your team have been drunk and flipped over, the process starts again with the first person at the 50 yard line.

(F.) The next sequence is you have to place your cup 56 upright on the dashed circle 32, then bounce a ping pong ball 146 into your cup 56. Once you bounce your ping pong ball 146 into your cup 56, then the next person at the next lower number to your let does the same. When players on your team get the ping pong ball 146 into their cup 56, the ping pong ball 146 goes back to player number one.

(G.) The final sequence is to bounce the ping pong ball 146 into the full cup 56 of drink in the center of the board 16. The first team to achieve all of the sequences wins! When a team wins, the contents of the center cup 56, has to be drunk, by the opposing team member that is attempting the sequence.

Figure 11:
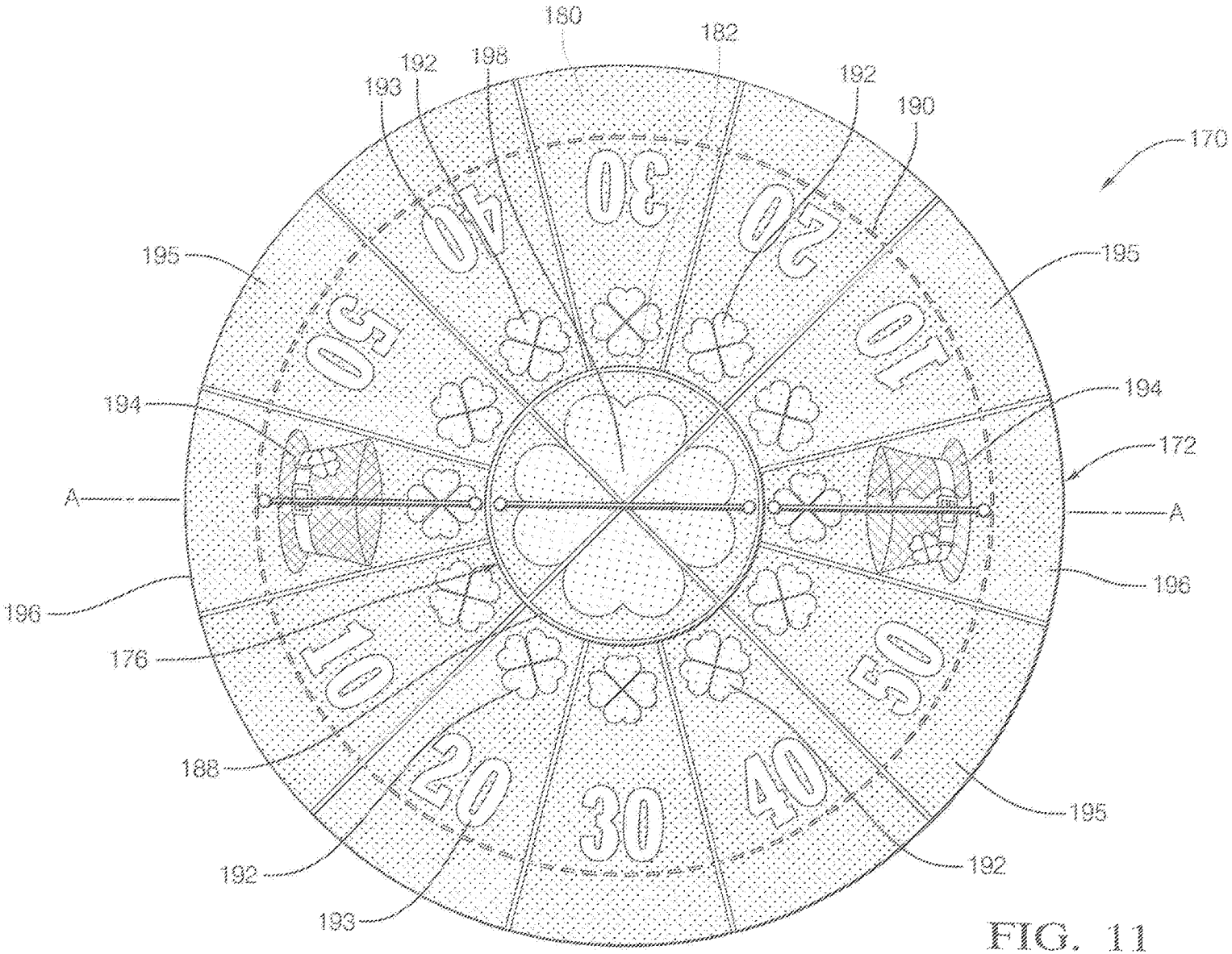
FIG. 11, is a top plan view of an alternative embodiment of the present invention, structured similarly to that depicted in FIGS. 1-3, but with more rigid construction appropriate for semi-permanent or indoor use, with an entirely different (non-sport related) decorative motif, and the addition of a net system bifurcating the playing surfaces between the teams to prevent a bouncing ping pong ball from intruding into an opponent's field of play and to enable simultaneous play by multiple teams without significant interference with one another.
Figure 12:
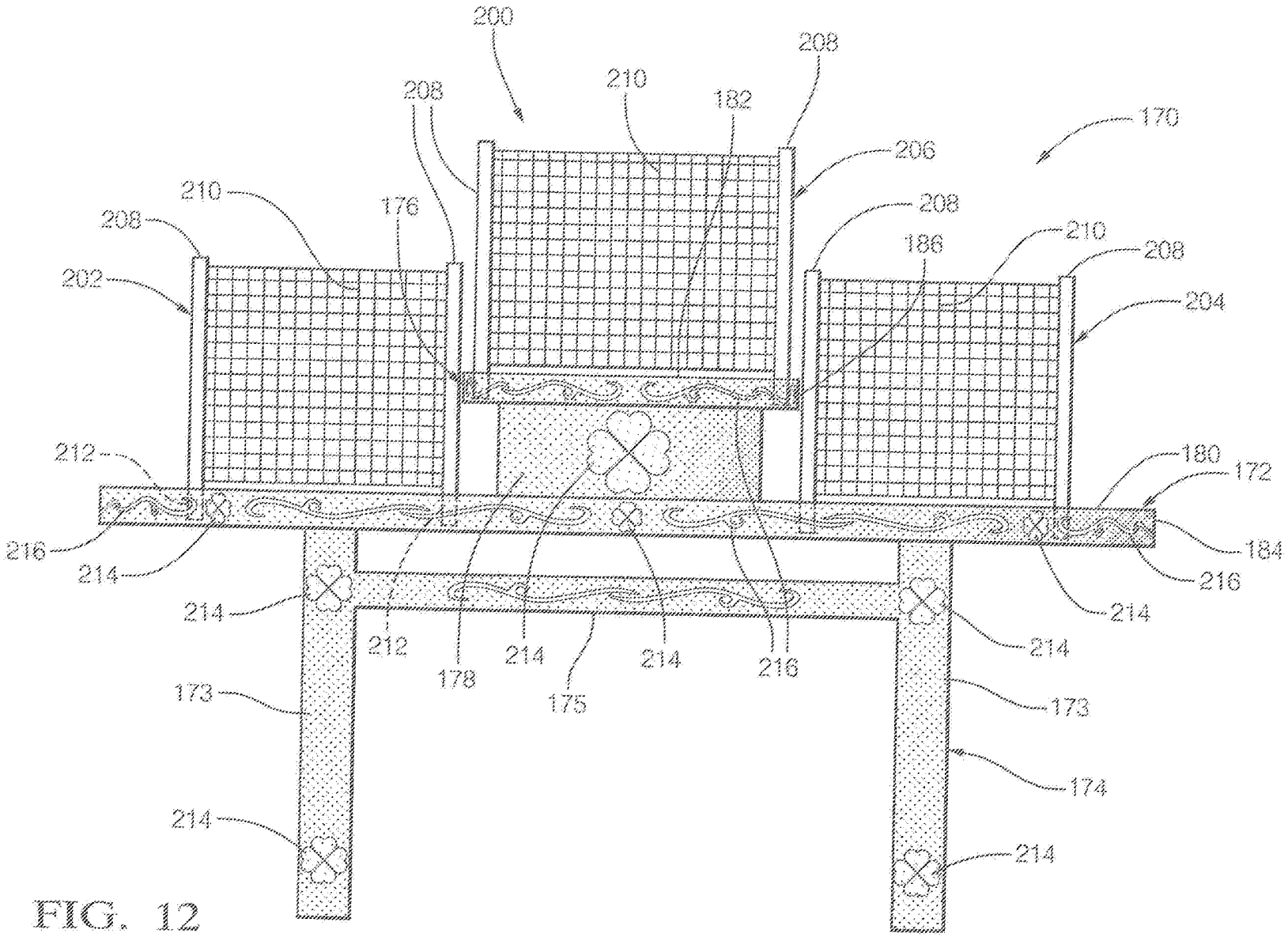
FIG. 12, is a side plan view of the alternative embodiment of FIG. 11, illustrating the net system and the extension of the decorative motif to the table edges, the vertical support member, legs and support structure.

Referring to FIGS. 11 and 12, a second embodiment of a game table assembly 170 includes a first or bottom table 172 supported on a rigid fixed leg assembly 174 affixed to the lower surface (not illustrated) thereof. The leg assembly 174 includes a plurality (such as 4) circumferentially spaced legs 173 and a plurality (such as 4) of cross members 175 interconnecting adjacent leg pairs 173. A second or top table 176 is arranged concentrically above the bottom table 172 and is retained in a fixed position by a vertically elongated support member 178. The tables 172 and 176 can be fabricated from composite material such as plywood which is subsequently painted, but preferably are injection or blow molded from plastic with the artwork integrated therein.

FIGS. 11 and 12 illustrate the detail of a playing surface 180 of the bottom table 172 and a playing surface 182 of the top table 176, which are decorated and colored in an Irish/St. Patrick motif. The design can be altered depending upon the theme, activity or the like. Tables 172 and 176 are round and form circumferentially continuous outwardly facing edges 184 and 186, respectively. The playing surfaces 180 and 182 are illustrated in a dark green color with a circular hub 188 defined by a concentric line. Twelve equally spaced circumferential radial lines or rays, similar to rays 26A-26L of FIG. 2 extend from the hub 188 to the outer edge 172. An outer cup positioning marker 190 is illustrated as a dotted circle concentric with the playing surface 180 located inwardly from the outer edge 184. Similarly, four equally spaced circumferential radial lines or rays, similar to rays 46A-46F of FIG. 3 extend from the geometric center of the second table 176 to the outer edge 188.

Scaled indicia 193 such as white colored consecutive point marker designations"10", "20", "30", "40" and "50", are disposed within associated play segments 195. Game themed indicia such as shamrocks 192 are disposed within play segments 195 constituting inner cup positioning markers. Game themed indicia such as stylized leprechaun hats 194 are disposed within neutral play segments 196. A single large shamrock 198 covers the playing surface 182 of the second table 176.

A vertically upstanding net assembly 200 bifurcates the playing surfaces 180 and 182 of the first and second tables 172 and 176, respectively, extending radially through neutral play segments 196 along an axis designated A-A. The net assembly 200 extends well above the upper lip of the largest cup employed in any intended game, effectively forming a barrier preventing a ping pong ball in play by one team front entering the opposing team' playing area.

Although the net assembly 200 could consist of a single, continuous net extending the entire diameter of the lower table 172, it preferably consists of three distinct segments, left and right outer segments 202 and 204, respectively, and center segment 206. Each net segment 202, 204 and 206 consists of an opposed pair of vertical support stanchions 208 interconnecting a net portion 210 in tension. Each stanchion 208 is slip fit within a blind bore 212 formed in the playing surfaces 180 and 182 of the bottom and upper tables 172 and 176, respectively. So constructed, one or more of the net segments 200, 202 and 204 can be removed to change the nature of the game.

Additional decorative shamrocks 214 and pinstripes 216 can be added as desired to the table edges 184 and 186, the elongated support member 178, the legs 173 and the cross members 175 for ornamental appeal.

The enlarged shamrock 198 is centered on the playing surface 182 of the top table 176 and is bifurcated by the center net segment 206. The shamrock 198 is enlarged to form a double circular hub comparable to the circular hub 44 of the playing surface 40 of the top table 42 of FIGS. 1 and 3. The net assembly 200 requires the use of two cups within the shamrock 198, one on each side of the center segment 206 of the net assembly 200, one fix each of the opposing teams.

The following documents are deemed to provide a fuller background disclosure of the inventions described herein and the manner of making and using same. Accordingly, each the below-listed documents are hereby incorporated into the specification hereof by reference.

Wikipedia Rules regarding "Beer Pong" date unknown.

Wikipedia Rules regarding "Flip Cup" date unknown.

U.S. Pat. No. 3,372,934 to Heil entitled "Game Board and Small Bounceable Ball".

U.S. Pat. No. 5,007,650 to Reed et al entitled "Method of Playing a Board Game of College Social Life".

U.S. Pat. No. 6,276,686 B1 to Chille entitled "Board Game and Method for Teaching Responsible Drinking".

U.S. Patent Application Publication No. 2004/0188942 A1 to Trokan entitled "Non-Alcoholic Beer-Pong System".

U.S. Patent Application Publication No. 2005/0029747 A1 to Grayson entitled "Drinking Game Cup Holder".

U.S. Patent Application Publication No, 2005/0116413 A1 to Wagner entitled "Board Game Incorporating Drinking Beverages and Method of Playing Board Game, and Board and Gamepieces Thereof and Method of Use Thereof".

U.S. Patent Application Publication No. 2006/0226606 A1 to Finley et al, entitled "Portable Game Device and Method of Use", U.S. Patent Application Publication No. 2007/0200293 A1 to Gomez et al, entitled "Board Game and Method with Social Drinking Theme".

U.S. Pat. No. 7,325,807 B1 to Eason entitled "Beer Pong Table".

U.S. Pat. No. 7,516,960 B1 to Battiste entitled "Inflatable Table".

U.S. Pat. No. 7,805,959 B2 to Webb et at. entitled "Cup Holder for Drinking Game".

U.S. Patent Application Publication No. 2014/0015197 A1 to Maffei et al. entitled "Beer Pong Game and Method of Playing".

U.S. Pat. No. 8,905,406 B2 to Brown entitled "Portable Point/Beer Pong Table".

U.S. Design Patent No. D755,898 S to Blanchard entitled "Cap for Beer Pong Game".

It is to be understood that the invention has been described with reference to specific embodiments and variations to provide the features and advantages previously described and that the embodiments are susceptible of modification as will be apparent to those skilled in the art.

Furthermore, it is contemplated that many alternative, common inexpensive materials can be employed to construct the basis constituent components. Accordingly, the forgoing is not to be construed in a limiting sense.

The invention has been described in an illustrative manner, and it is to be understood that the terminology, which has been used is intended to be in the nature of words of description rather than of limitation.

Obviously, many modifications and variations of the present invention are possible in light of the above teachings. For example, the circular hub lines defining part of the generally traps zoidally shaped play segments can be imaginary, meaning that they can be a designated circular location, but not necessarily imprinted or formed on the playing surface. Furthermore, temporary covers for the upper and lower table portions can be provided for post-game food service. The upper table portion can be converted into a "lazy Susan" condiment server. It is, therefore, to be understood that within the scope of the appended claims, wherein reference numerals are merely for illustrative purposes and convenience and are not in any way limiting, the invention, which is defined by the following claims as interpreted according to the principles of patent law, including the Doctrine of Equivalents, may be practiced otherwise than is specifically described.

The invention claimed is:

1. A compact, multi-level beer pong table game assembly for use in a game including at least one ping pong game ball and a plurality of ball receiving open topped beverage cups, each cup having a nominal height h and a maximum lip diameter d1, wherein said table game assembly comprises:

a first table forming a substantially circular upwardly facing flat/smooth horizontal playing surface and a circumferentially continuous outwardly facing edge having a nominal diameter of dimension D1;

a second table forming a second substantially circular upwardly facing flat/smooth horizontal playing surface, a bottom surface and a circumferentially continuous outwardly facing edge having a nominal diameter of dimension D2, wherein dimension D1 is greater than the sum of dimension D2 plus two times the cup maximum lip diameter d1;

a vertically adjustable support member concentrically rigidly interconnecting the first table playing surface with the second table bottom surface, said support member having a maximum lateral dimension equaling D2 and vertically interspacing the first and second table playing surfaces by a dimension approximately equaling nominal beverage cup height h;

a plurality of circumferentially arranged cup positioning markers disposed within associated play segments formed on said first and second table playing surfaces for locating said beverage cups thereon, said cup positioning markers located on said first table playing surface being disposed radially intermediate said first table outwardly facing edge and said second table outwardly facing edge;

a circumferentially opposed pair of neutral play segments formed on said first table playing surface; and an elongated barrier or net assembly extending vertically above said first and second playing surfaces and extending horizontally between said opposed pair of neutral play segments bisecting said first upwardly facing playing surface and said second upwardly facing playing surface, said vertical barrier operative to define discrete opposed team play areas enabling a plurality of teams to play simultaneously on opposed sides of said barrier and to prevent horizontal travel of ping pong balls between opposing team play areas, said barrier supported by a plurality of vertically elongated support stanchions, each stanchion dimensioned for removable slip-fit within an associated blind bore formed within said playing surfaces to enable selective removal and insertion thereof.

2. The table game assembly of claim 1, further comprising at least one leveling device supported by said game table operable to affect two axis leveling.

3. The table game assembly of claim 1, wherein said first table forms a downwardly facing flat bottom surface spaced below said first playing surface.

4. The table game assembly of claim 3, further comprising a plurality of elongated, legs removably affixed to the flat bottom surface of said first table.

5. The table game assembly of claim 4, wherein said plurality of elongated legs are each individually telescopingly adjustable in length.

6. The table game assembly of claim 5, wherein at least one of said plurality of elongated legs forms a lower end terminating in a ground penetrating extension serving to fixedly anchor the table game assembly to the underlying ground surface.

7. The table game assembly of claim 3, wherein said first table is bifurcated into two semicircular shapes, hinged along the flat bottom surface.

8. The table game assembly of claim 1, wherein said support member is operable to selectively incrementally or infinitely vary vertical spacing between the first and second table playing surfaces to dimensionally approximate said beverage cup height h employed in a given game.

9. The table game assembly of claim 1, wherein said first table bottom surface forms at least one shaped cavity configured and dimensioned to receive and store the second table, the support member, game legs, and/or game balls.

10. The table game assembly of claim 1, further comprising a ball receiving beverage cup height extender comprising a tapered open topped base portion dimensioned to slidingly receive a standard cup to enhance its effective vertical height, and a radially outwardly extending base flange to enhance stability of the combined cup and height extender, wherein the total height $h_e$ of a standard cup fitted within the beverage cup height extender substantially corresponds with the vertical displacement between the first table playing surface and the second table playing surface.

11. The table game assembly of claim 10, wherein said beverage cup height extender includes a layer of resilient or adhesive material affixed to the said base flange operative to affix said beverage height extender to said first or second playing surfaces.

12. The table game assembly of claim 10, wherein a plurality of said beverage cup height extenders are employed on said first and/or second playing surfaces.

13. The table game assembly of claim 1, wherein D1~3× D2.

14. The table game assembly of claim 1, wherein at least one said second table inner cup positioning markers is normally enlarged to extend on both sides of said barrier to receive separate cups simultaneously on both opposed sides of said barrier.

* * * * *